US012685384B2

(12) United States Patent
Jimenez et al.

(10) Patent No.: US 12,685,384 B2
(45) Date of Patent: Jul. 21, 2026

(54) ORAL CARE IMPLEMENT

(71) Applicant: Colgate-Palmolive Company, New York, NY (US)

(72) Inventors: Eduardo Jimenez, Manalapan, NJ (US); Bruce Cummings, New York, NY (US); Renee Marie Riethmiller, Larchmont, NY (US)

(73) Assignee: Colgate-Palmolive Company, New York, NY (US)

( * ) Notice: Subject to any disclaimer, the term of this patent is extended or adjusted under 35 U.S.C. 154(b) by 501 days.

(21) Appl. No.: 18/252,953

(22) PCT Filed: Nov. 1, 2021

(86) PCT No.: PCT/US2021/057528

§ 371 (c)(1),
(2) Date: May 15, 2023

(87) PCT Pub. No.: WO2022/103612

PCT Pub. Date: May 19, 2022

(65) Prior Publication Data

US 2023/0413982 A1 Dec. 28, 2023

Related U.S. Application Data

(60) Provisional application No. 63/114,097, filed on Nov. 16, 2020.

(51) Int. Cl.
*A46B 5/02* (2006.01)
*A46B 5/00* (2006.01)
(Continued)

(52) U.S. Cl.
CPC ..... *A46B 5/025* (2013.01); *A46B 5/021* (2013.01); *A46B 5/026* (2013.01); *A46B 9/04* (2013.01);
(Continued)

(58) Field of Classification Search
CPC ..... A46B 15/0097; A46B 5/025; A46B 5/021; A46B 5/02; A46B 9/04; A46B 2200/1066
(Continued)

(56) References Cited

U.S. PATENT DOCUMENTS 2,835,912 A 5/1958 Pensky
4,259,761 A * 4/1981 Earle ..... A46B 5/02 16/DIG. 12
(Continued)

FOREIGN PATENT DOCUMENTS

CN 201431102 3/2010
CN 305318882 8/2019
(Continued)

OTHER PUBLICATIONS

International Search Report and the Written Opinion of the International Searching Authority issued in International Application PCT/US2021/057528 mailed Jan. 28, 2022.
(Continued)

*Primary Examiner* — Laura C Guidotti

(57) ABSTRACT

An oral care implement that is designed for users with reduced dexterity in their hands. In particular, the oral care implement includes a handle portion that includes a gripping portion configured to be gripped by the hand of a user and a grip stop protruding from the gripping portion in a cantilevered manner. The grip stop may be positioned near the end of the handle adjacent to the head of the oral care implement to stop movement of the user's hand upwards towards the head. The grip stop extends from the gripping portion a distance that is greater than a width or diameter of an adult finger to ensure it functions as a stop. In one embodiment, the grip stop may be rotatably or pivotably coupled to the gripping portion so that its exact circumferential position can be modified to enhance user comfort.

18 Claims, 15 Drawing Sheets

(51) Int. Cl.
*A46B 9/04* (2006.01)
*A46B 15/00* (2006.01)

(52) U.S. Cl.
CPC .. *A46B 15/0097* (2013.01); *A46B 2200/1066* (2013.01)

(58) Field of Classification Search
USPC ..... 16/430
See application file for complete search history.

(56) References Cited

U.S. PATENT DOCUMENTS

| | | | | |
|---|---|---|---|---|
| 4,283,854 | A * | 8/1981 | Austin | B26B 3/06 30/340 |
| 4,606,484 | A | 8/1986 | Winter et al. | |
| 4,922,575 | A | 5/1990 | Riemann | |
| 5,774,921 | A | 7/1998 | Harrison et al. | |
| 5,791,705 | A | 8/1998 | Romero et al. | |
| 6,131,231 | A * | 10/2000 | Huang | A46B 5/02 15/105 |
| 7,089,621 | B2 | 8/2006 | Hohlbein | |
| D527,527 | S | 9/2006 | Ramelli | |
| D577,198 | S | 9/2008 | Jimenez et al. | |
| 7,975,343 | B2 | 7/2011 | Hohlbein et al. | |
| 8,539,630 | B2 | 9/2013 | Gatzemeyer et al. | |
| 8,769,832 | B1 | 7/2014 | Joyner | |
| 9,044,853 | B2 | 6/2015 | Phui | |
| D775,470 | S | 1/2017 | Xi et al. | |
| D799,218 | S | 10/2017 | Okai | |
| D799,835 | S | 10/2017 | Okai | |
| D807,693 | S | 1/2018 | Obmaces | |
| D823,000 | S | 7/2018 | Wainless et al. | |
| D828,035 | S | 9/2018 | Wainless et al. | |
| 10,258,551 | B2 | 4/2019 | Rege et al. | |
| D851,938 | S | 6/2019 | Bloch et al. | |
| 10,413,048 | B2 * | 9/2019 | Walther | A46B 5/02 |
| 10,449,022 | B2 | 10/2019 | Okai | |
| 10,449,663 | B2 | 10/2019 | Martin | |
| D866,193 | S | 11/2019 | Wainless et al. | |
| D866,194 | S | 11/2019 | Wainless et al. | |
| D867,762 | S | 11/2019 | Bloch et al. | |
| 10,603,147 | B2 | 3/2020 | Bloch et al. | |
| 10,631,964 | B2 | 4/2020 | Bloch et al. | |
| 10,639,133 | B2 | 5/2020 | Bloch et al. | |
| D887,148 | S | 6/2020 | Okai | |
| 10,709,533 | B2 | 7/2020 | Bloch et al. | |
| D895,973 | S | 9/2020 | Ji et al. | |
| D973,367 | S | 12/2022 | Jimenez et al. | |
| D974,765 | S | 1/2023 | Jimenez et al. | |
| 2008/0131842 | A1 | 6/2008 | Edwards | |
| 2009/0144921 | A1 | 6/2009 | Newsome | |
| 2009/0193599 | A1 * | 8/2009 | Stein | A46B 17/02 15/167.1 |
| 2015/0305483 | A1 | 10/2015 | Miller et al. | |

FOREIGN PATENT DOCUMENTS

| | | | | |
|---|---|---|---|---|
| CN | 305368567 | | 9/2019 | |
| CN | 305526416 | | 12/2019 | |
| CN | 305571153 | | 1/2020 | |
| CN | 305614134 | | 2/2020 | |
| CN | 305692562 | | 4/2020 | |
| JP | H1014659 | | 1/1998 | |
| KR | 10-2010-0103227 | * | 9/2010 | A46B 5/026 |
| WO | WO 2013/164893 | A1 * | 11/2013 | A46B 5/02 |
| WO | 2022/103612 | | 5/2022 | |

OTHER PUBLICATIONS

Taiwanese Search Report issues in Taiwan Appln. No. 110302513 on Dec. 2, 2021.
Taiwanese Search Report issues in Taiwan Appln. No. 110302514 on Dec. 2, 2021.
Taiwanese Search Report issues in Taiwan Appln. No. 110302515 on Dec. 3, 2021.
Taiwanese Search Report issues in Taiwan Appln. No. 110302516 on Dec. 4, 2021.

* cited by examiner

ORAL CARE IMPLEMENT

CROSS-REFERENCE TO RELATED APPLICATIONS

The present application claims priority to U.S. Provisional Patent Application Ser. No. 63/114,097, filed Nov. 16, 2020, the entirety of which is incorporated herein by reference.

BACKGROUND

Personal hygiene activities are notoriously difficult for people who suffer from loss of dexterity which may result from birth defects, arthritis, age, and other underlying health issues. For example, users with reduced dexterity may have difficulty holding and manipulating a toothbrush as it requires a tight grip on the handle of the toothbrush and rapid back-and-forth movements in order to adequately clean the teeth. Thus, a need exists for an oral care implement that provides for improved handling by users with reduced dexterity.

BRIEF SUMMARY

The present invention is directed to an oral care implement that is designed for users with reduced dexterity in their hands. In particular, the oral care implement includes a handle portion that includes a gripping portion configured to be gripped by the hand of a user and a grip stop protruding from the gripping portion in a cantilevered manner. The grip stop may be positioned near the end of the handle adjacent to the head of the oral care implement to stop movement of the user's hand upwards towards the head. The grip stop extends from the gripping portion a distance that is greater than a width or diameter of an adult finger to ensure it functions as a stop. In one embodiment, the grip stop may be rotatably or pivotably coupled to the gripping portion so that its exact circumferential position can be modified to enhance user comfort.

In one aspect, the invention may be an oral care implement comprising: a handle portion extending from a handle proximal end to a handle distal end along a handle axis, the handle portion comprising: a gripping portion configured to be gripped by a hand of a user and extending along the handle axis; and a grip stop protruding from the gripping portion in a cantilevered manner, the grip stop configured to contact the hand of the user to prevent movement of the hand, relative to the gripping portion, in a direction from the handle proximal end to the handle distal end.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
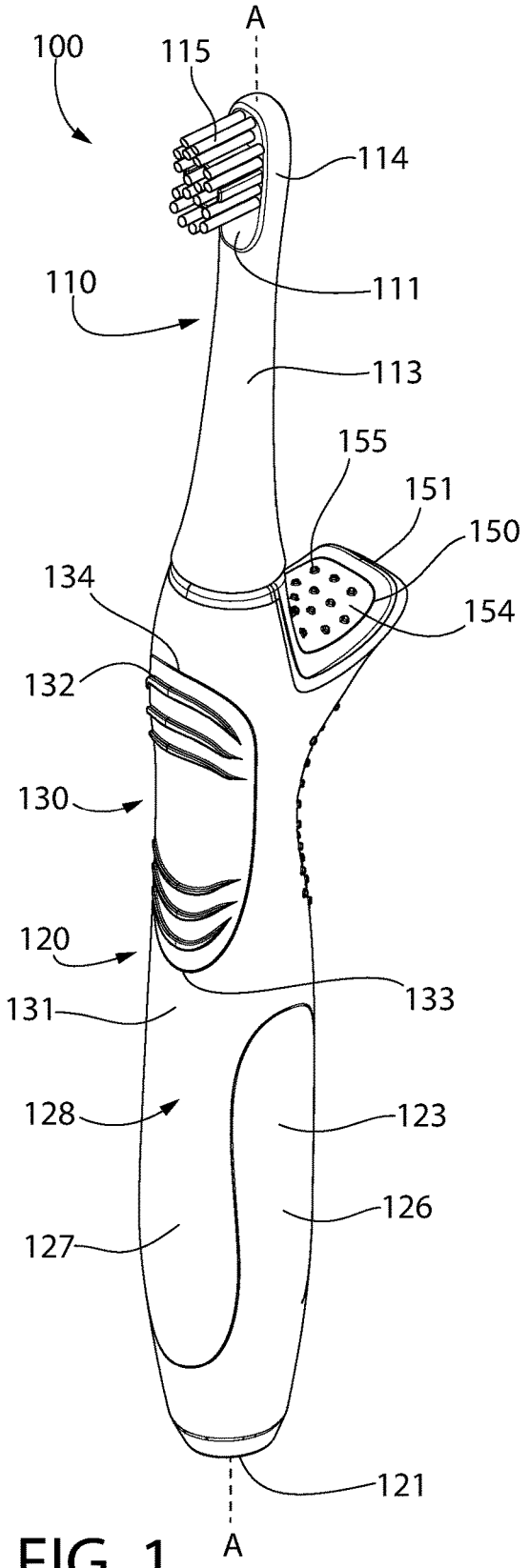
FIG. 1 is a front perspective view of an oral care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring first to FIGS. 1-6, an oral care implement 100 will be described in accordance with an embodiment of the present invention. In the exemplified embodiment, the oral care implement 100 is a toothbrush, and more particularly a manual toothbrush. However, the invention is not to be so limited in all embodiments and the oral care implement 100 may be an electric toothbrush in some alternative embodiments. In still other embodiments, the oral care implement 100 may perform other functions, such as being a flosser device, a tooth scraper, a tongue cleaner, or any of the various other tools that are commonly used for oral care.

Figure 3:
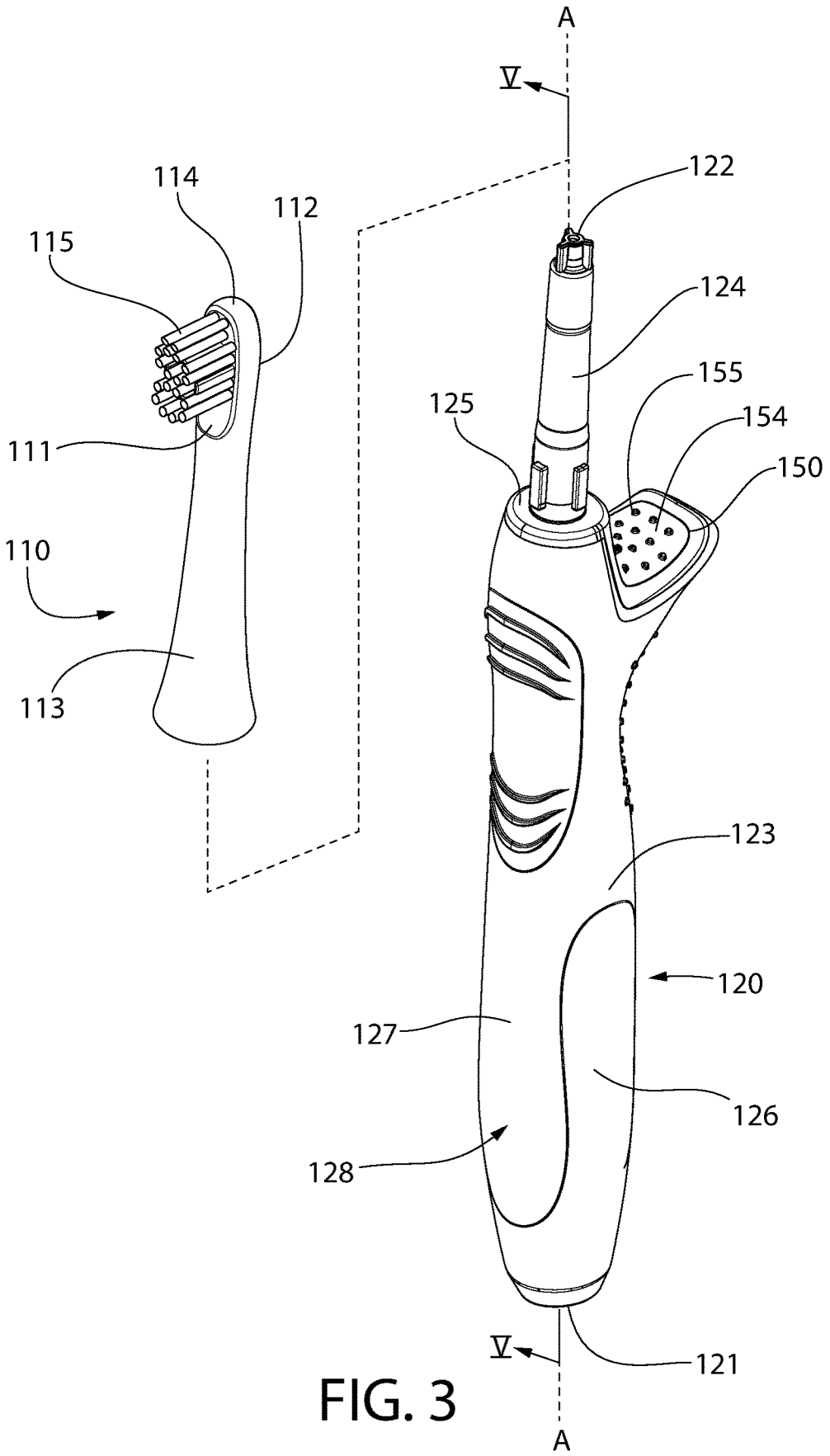
FIG. 3 is a front perspective view of the oral care implement of FIG. 1 illustrating a head portion thereof detached from a handle portion thereof.

The oral care implement 100 generally comprises a head portion 110 and a handle portion 120. As seen in FIG. 3, in the exemplified embodiment the head portion 110 is detachable from the handle portion 120. Thus, the head portion 110 can be replaced when the bristles thereon wear out and the handle portion 120 can be reused with a replacement head portion 110. Of course, in other embodiments the handle portion 120 and the head portion 110 may not be detachable and when the bristles are worn out the entire oral care implement 100 may need to be replaced.

The head portion 110 comprises a front surface 111 and a rear surface 112 opposite the front surface 111. Furthermore, the head portion 110 comprises a sleeve portion 113 and a head 114 that is coupled to the sleeve portion 113. The sleeve portion 113 defines a hollow interior (not visible in the provided figures) so that the sleeve portion 113 can be positioned around a stem of the handle portion 120 when the head portion 110 is coupled to the handle portion 110. A plurality of tooth cleaning elements 115 extend from the front surface 111 of the head portion 110 along the head 114 thereof. The tooth cleaning elements 115 may comprise bristles, rubber elements, or combinations thereof in various different embodiments of the present invention. The tooth cleaning elements 115 are illustrated as being arranged in a specific pattern in the exemplified embodiment, but the invention is not limited to this pattern. In fact, as far as the tooth cleaning elements 115 are concerned, the material, pattern, arrangement, and manner of attachment to the head portion 110 are not limiting of the invention unless specifically claimed as such. Thus, while the oral care implement 100 should include tooth cleaning elements 115 to perform the cleaning function, the details of those tooth cleaning elements 115 are not intended to be particularly limiting of the invention described and claimed herein.

The term "tooth cleaning elements" may be used herein in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Suitable elastomeric materials include any biocompatible resilient material suitable for uses in an oral hygiene apparatus, including thermoplastic elastomers, thermoplastic polyurethane, rubbers, or the like. The tooth cleaning elements 115 may be coupled to the head 114 using any technique now known or later discovered, including anchor free tufting, staples, in-mold tufting, PTt tufting, or the like.

The handle portion 120 extends from a handle proximal end 121 to a handle distal end 122 along a handle axis A-A. The handle proximal end 121 forms a bottom-most end of the oral care implement 100. The handle distal end 122 is the end of the handle portion 120 from which the head portion 110 extends. The handle portion 120 comprises a gripping portion 123 configured to be gripped by a handle of a user and a stem 124 extending from the gripping portion 123. That is, the gripping portion 123 extends along the handle axis A-A from the handle proximal end 121 to a shoulder 125, and the stem 124 extends along the handle axis A-A from the shoulder 125 to the handle distal end 122. The head portion 110 attaches to the handle portion 120 due to mating engagement between coupling elements on the head portion 110 (such as features which are located within the cavity defined by the sleeve portion 113, features located along the sleeve portion 113, openings formed into the sleeve portion 113, or the like) and coupling features on the stem 124 and/or shoulder 125. The invention is not limited to the specific manner in which the head portion 110 and the handle portion 120 are coupled together and various different coupling techniques can be used, including friction fit, mechanical engagement, detent/boss engagement, protrusions/recess engagement, snap-fit, or the like. However, in embodiments whereby the head portion 110 is detachable from the handle portion 120, the head portion 110 should be capable of being repetitively detached from and reattached to the handle portion 120 as many times as desired.

Figure 5:
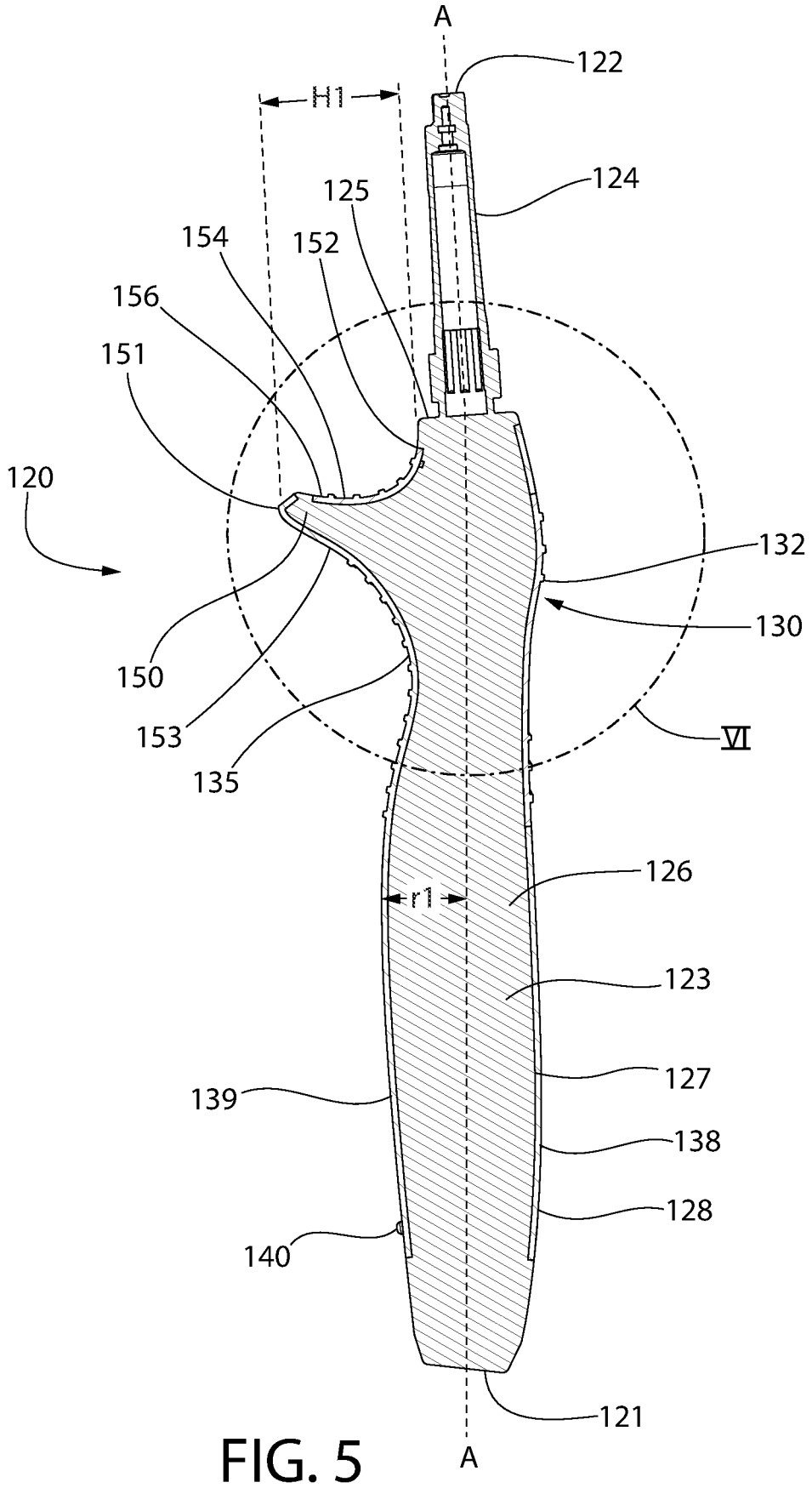
FIG. 5 is a cross-sectional view taken along line V-V of FIG. 3.

The gripping portion 123 of the handle portion 120 comprises an exposed surface outer surface 128, which is an entirety of the outer surface of the gripping portion 123 that is exposed to view. The exposed surface outer surface 128 includes a front exposed surface 138 and a rear exposed surface 139. The gripping portion 123 comprises a base member 126 formed from a hard plastic and a grip member 127 formed from a thermoplastic elastomer, thermoplastic polyurethane, rubber, or other material designed for comfort and enhanced grippability during use. During manufacturing, the base member 126 may be formed in a first injection molding process, and then the grip member 127 may be overmolded onto the base member 126 in a second injection molding process. The base member 126 defines the general shape of the gripping portion 123 and provides it with structural stability and the grip member 127 allows a user to obtain an enhanced grip during use. The grip member 127 may be overmolded onto the base member 126 and may include various protrusions, ridges, or the like to further enhance the ability of a user to grip the gripping portion 123 during use. The exposed surface outer surface 128 is formed from a combination of the base member 126 and the grip member 127. In fact, the base member 126 and the grip member 127 each form a part of the front exposed surface 138 and a part of the rear exposed surface 139 of the exposed surface outer surface 128, as best shown in FIG. 5.

The gripping portion 123 comprises a thumb grip 130 located on the front exposed surface 138 of the gripping portion 123. The thumb grip 130 may be formed from the grip member 127 described above. The thumb grip 130 may be integral with the remainder of the grip member 127, or it may be formed as its own distinct part of the grip member 127. Furthermore, the thumb grip 130 comprises a plurality of gripping protuberances 132 extending in a generally horizontal direction along the front exposed surface 138 of the gripping portion 123 to enhance user grip in that area. The gripping protuberances 132 protrude from the front exposed surface 138 of the gripping portion 123 so that they are readily discernable by a user's touch. While the gripping protuberances 132 are depicted as ridges in the exemplified embodiment, the gripping protuberances 132 could be nub-like protrusions, combinations of ridges and nub-like protrusions, or various other shaped protrusions in other embodiments while still increasing user grip in that region. The thumb grip 130 has an oval shape in the exemplified embodiment, although the invention is not to be so limited in all embodiments. The thumb grip 130 extends axially from a lower end 133 to an upper end 134. The lower end 133 of the thumb grip 130, which is the portion of the thumb grip 130 that is located closest to the handle proximal end 121, is located a first axial distance D1 from the handle proximal end 121.

Moreover, the handle portion 120 comprises a grip stop 150 protruding from the gripping portion 123. The grip stop 150 is an integral part of the handle portion 120 in this embodiment. In particular, the base member 126 of the gripping portion 123 protrudes outwardly to form a part of the grip stop 150 and to define its shape, and then the grip member 127 may overlie the base member 126 along the grip stop 150 to form a remainder of the grip stop 150. Thus, the grip stop 150 is not formed from a distinct component which is attached to or positioned around the handle portion 120 of the oral care implement 100. Rather, the grip stop 150 is formed as an integral part of the handle portion 120. Stated another way, if the handle portion 120 is formed via injection molding, the grip stop 150 is formed during that injection molding process as an integral part of the handle portion 120. The grip stop 150 is located adjacent to the handle distal end 122, and more particularly adjacent to the shoulder 125 which is formed at the distal end of the gripping portion 123 of the handle portion 120 of the oral care implement 100. In embodiments whereby the head portion 110 is non-detachable and forms an integral part of the oral care implement 100 along with the handle portion 120, the grip stop 150 may be located adjacent to a proximal end of the head portion 110.

The grip stop 150 protrudes from the gripping portion 123 of the handle portion 120 in a cantilevered manner. That is, the grip stop 150 protrudes from the exposed surface outer surface 128 of the gripping portion 123 to a free distal end 151 which is spaced from the exposed surface outer surface 128 by a distance. The grip stop 150 has a minimum height H1 measured from the exposed surface outer surface 128 of the gripping portion 123 at a base 152 of the grip stop 150 to the free distal end 151 of the grip stop 150, with the minimum height H1 being measured in a direction orthogonal to the handle axis A-A. The minimum height H1 of the grip stop 150 may be greater than or equal to 16 mm in some embodiments. This particular minimum height H1 is selected in some embodiments in order to ensure that the grip stop 150 extends from the exposed surface outer surface 128 of the gripping portion 123 a greater distance than a user's index finger when the user is gripping the handle portion 120 of the oral care implement 100. Thus, the statement that the minimum height H1 is greater than or equal to 16 mm is not a random selection, but has been specifically chosen to ensure that the grip stop 150 is capable of performing its intended function, which is to prevent movement of the user's hand, relative to the gripping portion 123 of the handle portion 120 in a direction from the handle proximal end 121 to the handle distal end 122.

In the exemplified embodiment, and as best shown in FIG. 5, the gripping portion 123 comprises a maximum radius r1 which is measured in a direction orthogonal to the handle axis A-A from the handle axis A-A to the exposed surface outer surface 128 of the gripping portion 123. In the exemplified embodiment, the minimum height H1 of the grip stop 150 is greater than the maximum radius r1 of the gripping portion 123.

Figure 2:
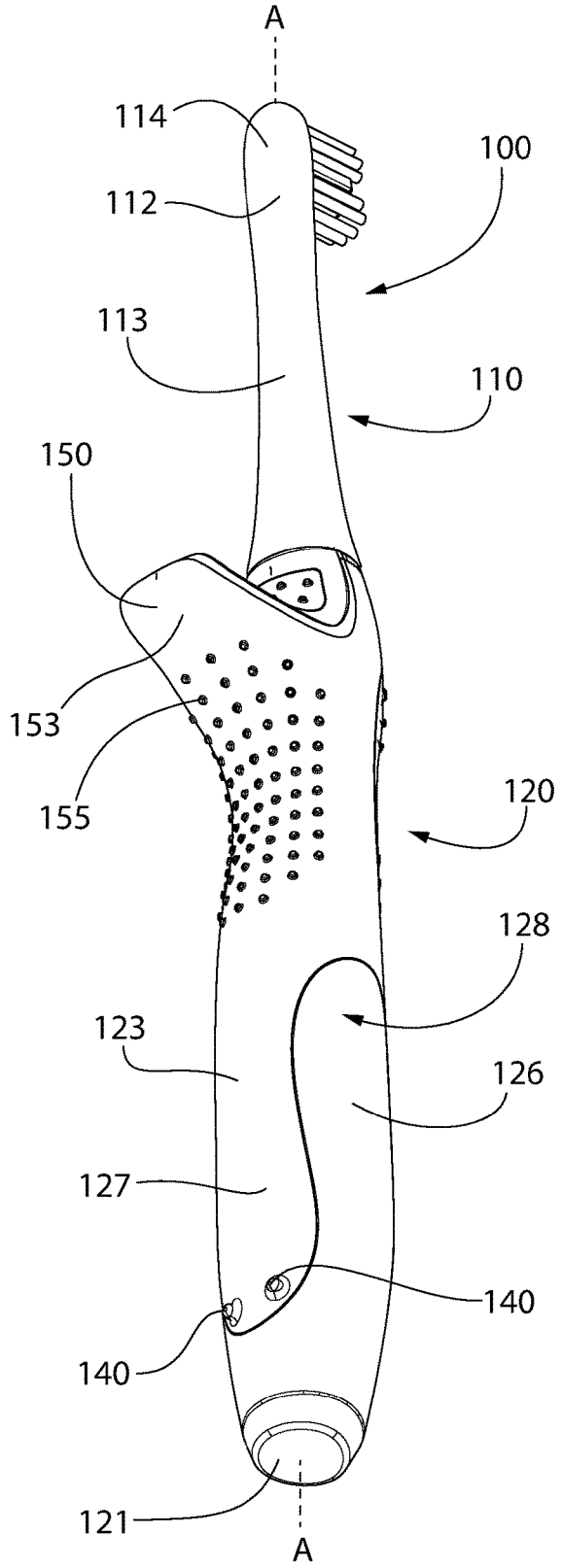
FIG. 2 is a rear perspective view of the oral care implement of FIG. 1.
Figure 8:
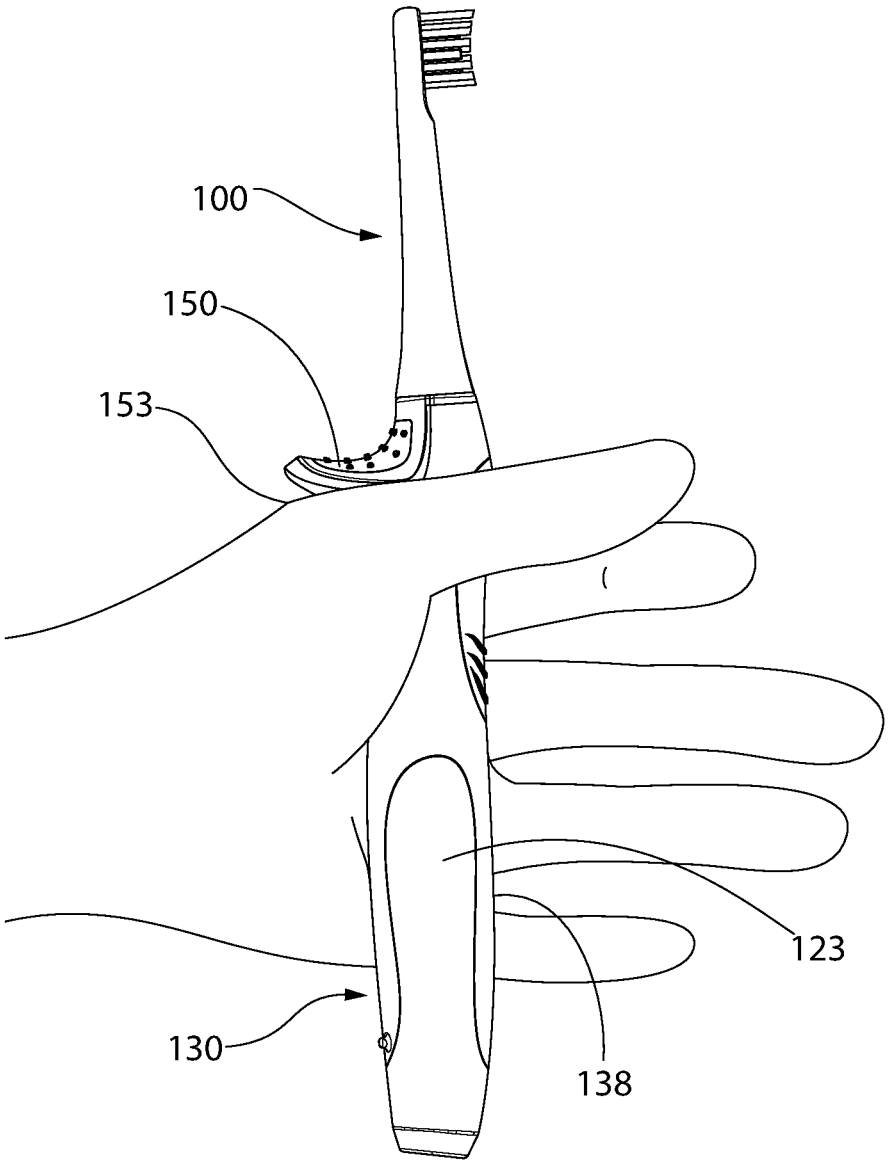
FIG. 8 is a side view of the oral care implement of FIG. 1 being held by a user's hand in a first handling configuration.
Figure 9:
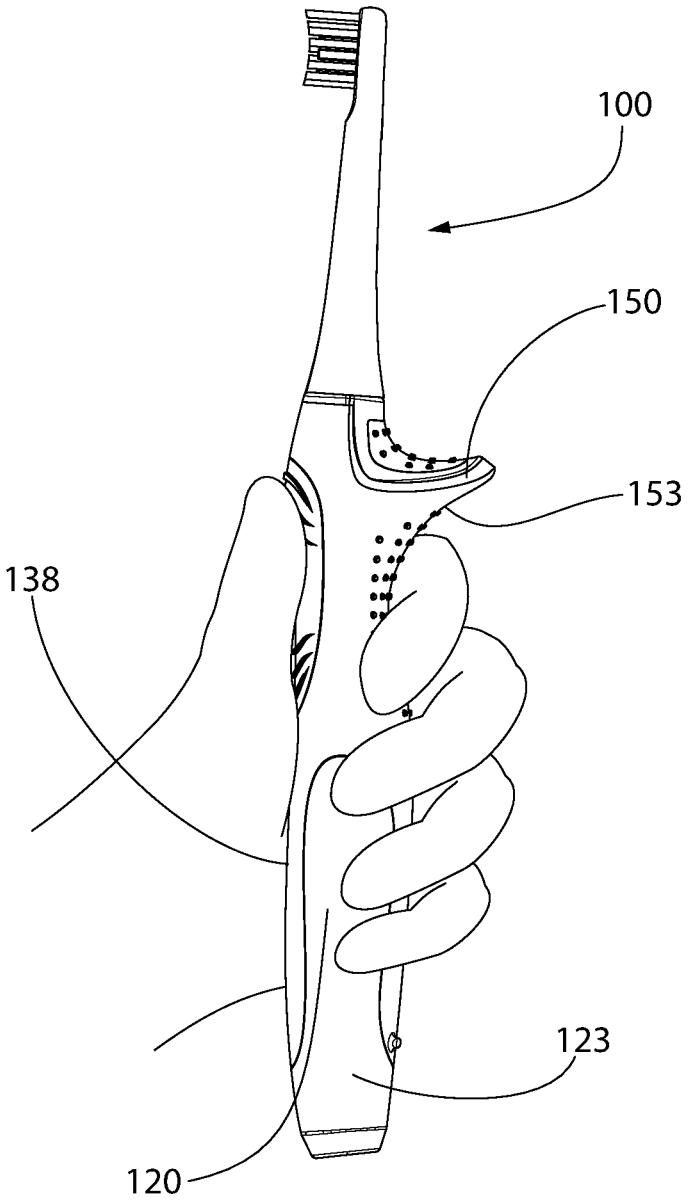
FIG. 9 is a side view of the oral care implement of FIG. 1 being held by a user's hand in a second handling configuration.
Figure 10:
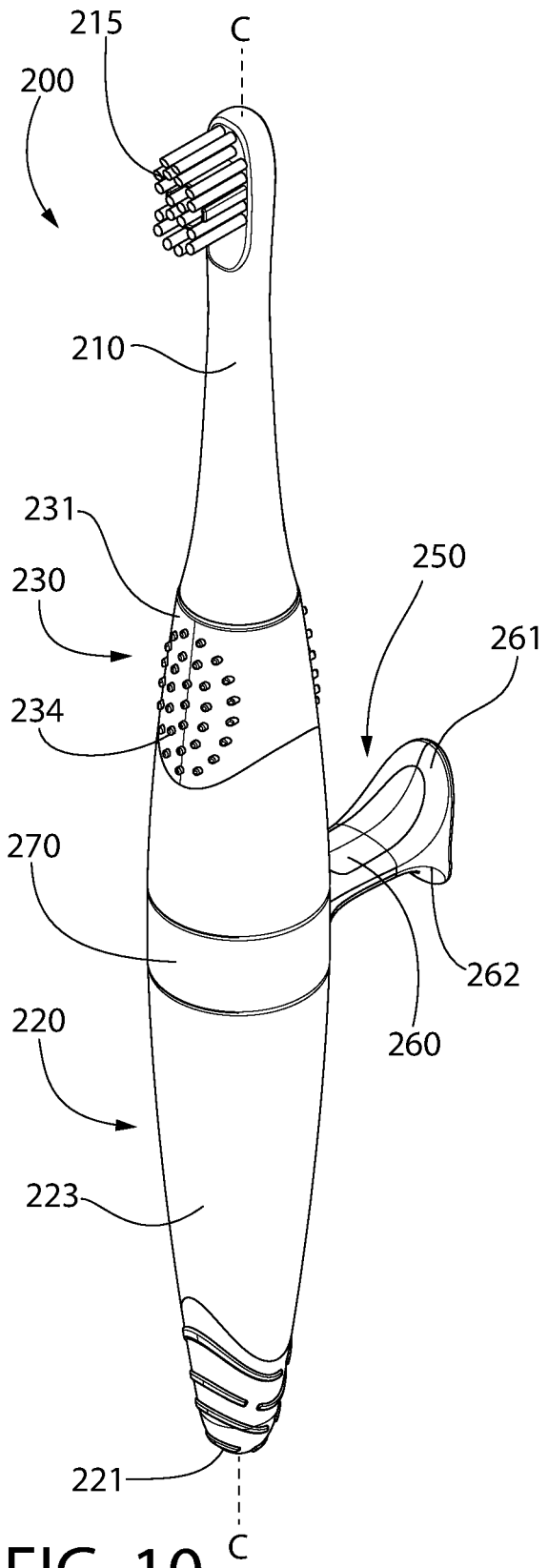
FIG. 10 is a front perspective view of an oral care implement in accordance with another embodiment of the present invention.
Figure 11:
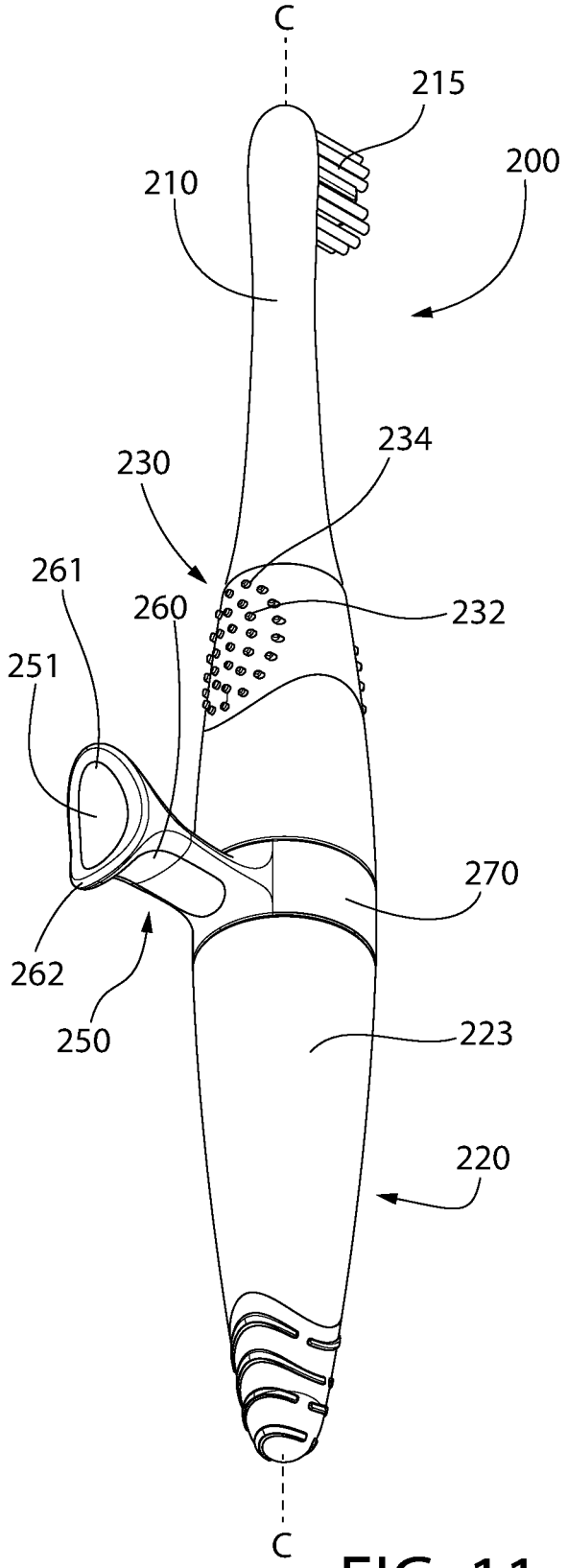
FIG. 11 is a rear perspective view of the oral care implement of FIG. 10.
Figure 12:
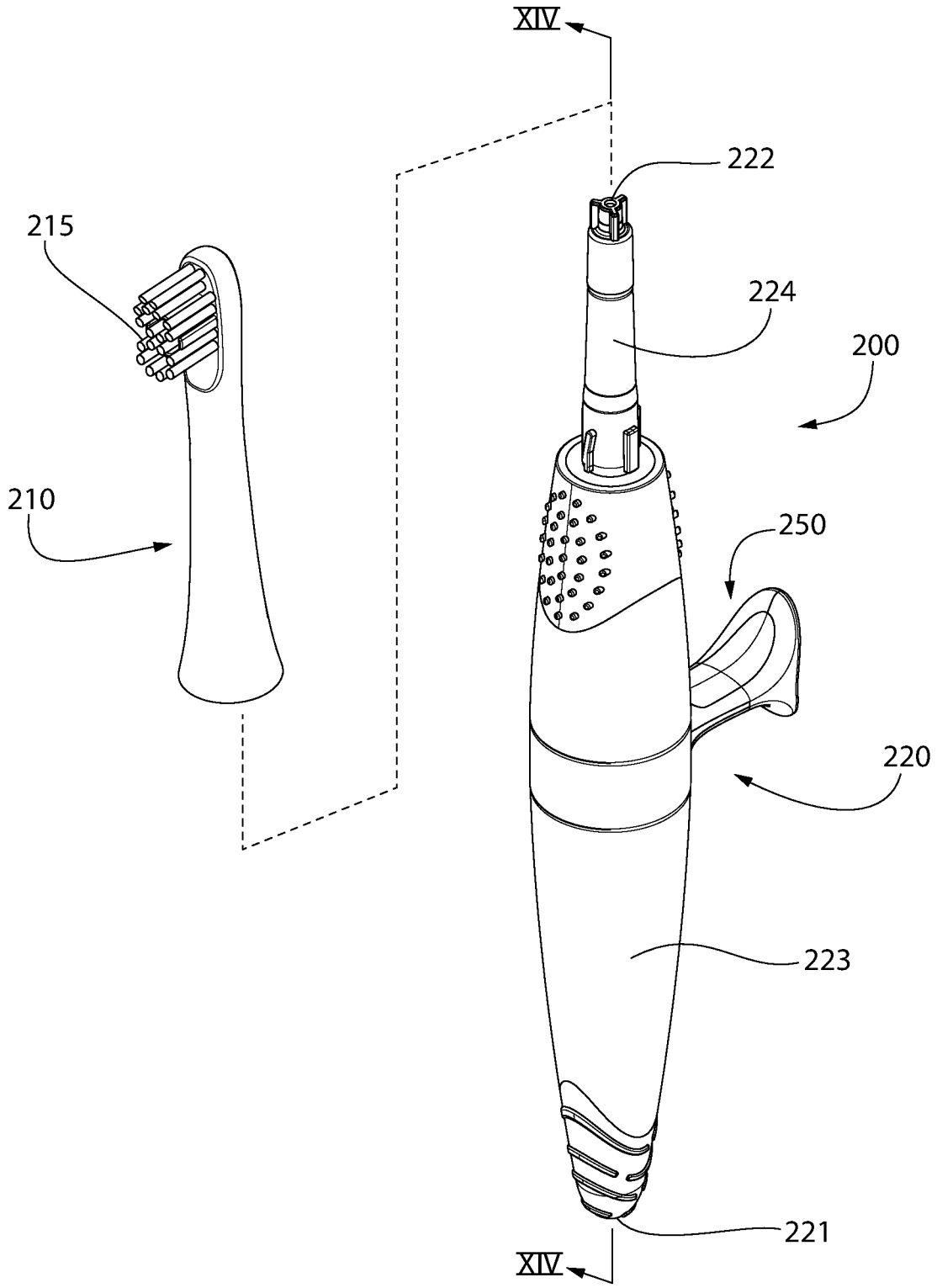
FIG. 12 is a front perspective view of the oral care implement of FIG. 10 illustrating a head portion thereof detached from a handle portion thereof.

As seen in FIGS. 1 and 2, when the head portion 110 is attached to the handle portion 120, the tooth cleaning elements 115 extend from the front surface 111 of the head portion 110 in a first direction orthogonal to the handle axis A-A. Moreover, the grip stop 150 protrudes from a rear exposed surface of the gripping portion 123 in a second direction orthogonal to the handle axis A-A. In the exemplified embodiment, the second direction is opposite to the first direction. Thus, the tooth cleaning elements 115 extend in one direction and the grip stop 150 extends in a second direction that is opposite the first direction. When a user is using the oral care implement 100 to brush teeth or otherwise clean the oral cavity, the grip stop 150 will extend only in the direction opposite the bristles. So, if the tooth cleaning elements 115 are facing downwardly, the grip stop 150 is facing upwardly, and so on. The grip stop 150 abuts against portions of a user's hand that are located along the rear of the gripping portion 123 during use of the oral care implement 100, as shown in FIGS. 8 and 9.

The grip stop 150 comprises a lower wall surface 153 and an upper wall surface 154, each of which extends from the base 152 of the grip stop 150 to the distal end 151 of the grip stop 150. The lower and upper wall surfaces 153, 154 are both concave or comprise concave portions in the exemplified embodiment. The exposed surface outer surface 128 of the gripping portion 123 of the handle portion 120 comprises a depression 135 located just beneath the lower wall surface 153 of the grip stop 150. Like the grip stop 150, the depression is located on the rear exposed surface 139 of the gripping portion 123 of the handle portion 120. The depression 135 is a concave shaped portion of the rear exposed surface 139 of the gripping portion 123 of the handle portion 120. The handle portion 120 transitions seamlessly from the concave depression 135 to the concave lower wall surface 153 of the grip stop 150. The depression 135 provides a nesting region for a user's fingers during handling and use of the oral care implement 100. In fact, the lower wall surface 153 of the grip stop 150 and the depression 135 on the rear exposed surface 139 of the gripping portion 123 form a continuous concave surface in the exemplified embodiment. As noted previously, in the exemplified embodiment the grip member 127 extends onto the grip stop 150, and in fact forms a part of the lower wall surface 153 and a part of the upper wall surface 154 of the grip stop 150.

In the exemplified embodiment, the lower wall surface 153 extends upwardly and outwardly from the exposed surface outer surface 128 of the gripping portion 123 to the free distal end 151 of the grip stop 150. Thus, the concavity of the lower wall surface 153 faces generally downwardly towards the handle proximal end 121 and away from the handle axis A-A. The upper wall surface 154 of the grip stop 150 extends downwardly from the exposed surface outer surface 128 of the gripping portion 123 to a transition region 156, and then extends upwardly from the transition region 156 to the free distal end 151. Thus, in the exemplified embodiment the grip stop 150 comprises a generally V-shaped member whereby each leg of the V is concave, although each leg of the V need not be concave in all embodiments.

The grip stop 150 extends from the base 152 to the free distal end 151 along a grip stop axis B-B. In the exemplified embodiment, the grip stop axis B-B is oriented obliquely relative to the handle axis A-A. More specifically, the grip stop axis B-B extends downwardly in a direction towards the handle proximal end 121 as it extends from the free distal end 151 of the grip stop 150 to the handle axis A-A. The grip stop axis B-B may intersect the handle axis A-A at an angle Θ1 of between 45° and 85° more specifically between 60° and 85°, and still more specifically between 70° and 85°.

In the exemplified embodiment there are a plurality of gripping protuberances 155 protruding from the lower and upper wall surfaces 153, 154. In the exemplified embodiment, there are gripping protuberances 155 protruding from both of the lower and upper wall surfaces 153, 154. However, the invention is not to be so limited in all embodiments and in some alternative embodiments the gripping protuberances 155 may protrude from one of the lower and upper wall surfaces 153, 154, but not both. In the exemplified embodiment, the gripping protuberances 155 are located on the upper wall surface 154, the lower wall surface 153, and along the depression 135 which is immediately beneath the lower wall surface 153 as discussed above. In the exemplified embodiment, the gripping protuberances 155 are nub-like protrusions, although they could take on other shapes and forms in other embodiments. The gripping protuberances 155 are formed as an integral part of the grip member 127 such that they are formed from rubber such as a thermoplastic elastomer or the like to enhance a user's grip during use of the oral care implement 100. In the exemplified embodiment, a distal portion 157 of the grip stop 150 which includes the free distal end 151 of the grip stop 150 is free of any protuberances thereon.

Figure 6:
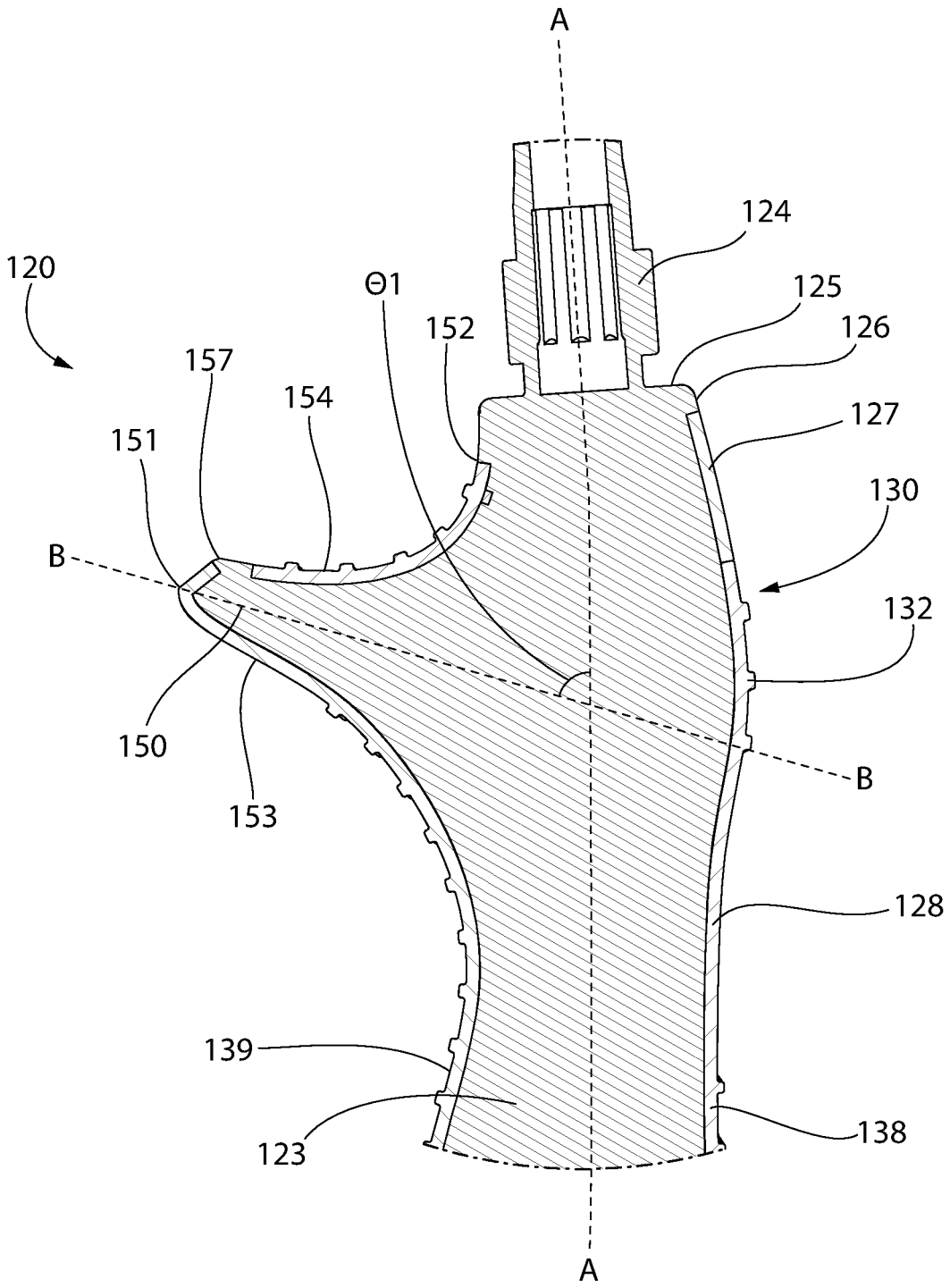
FIG. 6 is a close-up view of area VI of FIG. 5.

As noted above, the lower and upper wall surfaces 153, 154 terminate at the free distal end 151. In the exemplified embodiment, the free distal end 151 is convex and rounded. The grip member 127 extends onto and along the free distal end 151 as best seen in FIG. 6. The oral care implement 100 also includes two stand protuberances 140 located on the rear exposed surface of the gripping portion 123 adjacent to the handle proximal end 121. Although two of the stand protuberances 140 are depicted in the exemplified embodiment, one or more than two of the stand protuberances 140 could be used in other embodiments. The stand protuberances 140 are formed as an integral part of the grip member 128 in the exemplified embodiment. The stand protuberances 140 protrude from the rear exposed surface 139 of the gripping portion 123 of the handle portion 120 and are used to maintain the oral care implement 100 in a desired position when it is resting atop of a horizontal surface, as described below with reference to FIG. 7.

Figure 4:
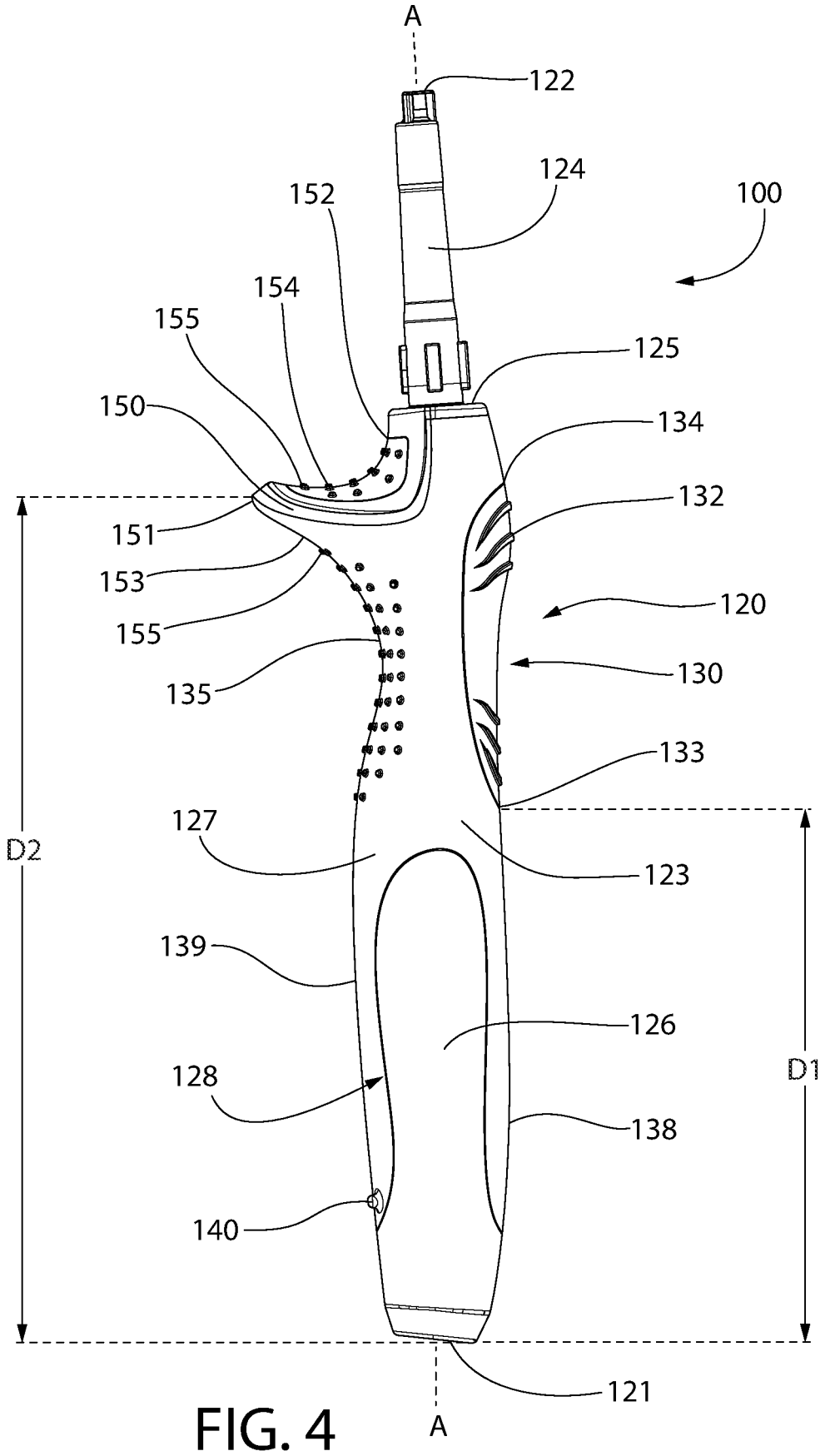
FIG. 4 is a side view of the handle portion of the oral care implement of FIG. 1.

As best seen in FIG. 4, the grip stop 150 is at least partially aligned with the thumb grip 130 in the axial direction. That is, the free distal end 151 of the grip stop 150 is radially aligned with the thumb grip 130, although the grip stop 150 and the thumb grip 130 are located on opposite sides of the gripping portion 123 of the handle portion 120. As noted above, the lower end 131 of the thumb grip 130 is located the first axial distance D1 from the handle proximal end 121. Moreover, the free distal end 151 of the grip stop 150 is located a second axial distance D2 from the handle proximal end 121. The second axial distance D2 is greater than the first axial distance, and thus the free distal end 151 of the thumb grip 150 is located further from the handle proximal end 121 than the lower end 131 of the thumb grip 130. Thus, while a user's thumb is resting against the thumb grip 130 during use of the oral care implement 100, the user's index finger will likely abut against the lower wall surface 153 of the grip stop 150.

Figure 7:
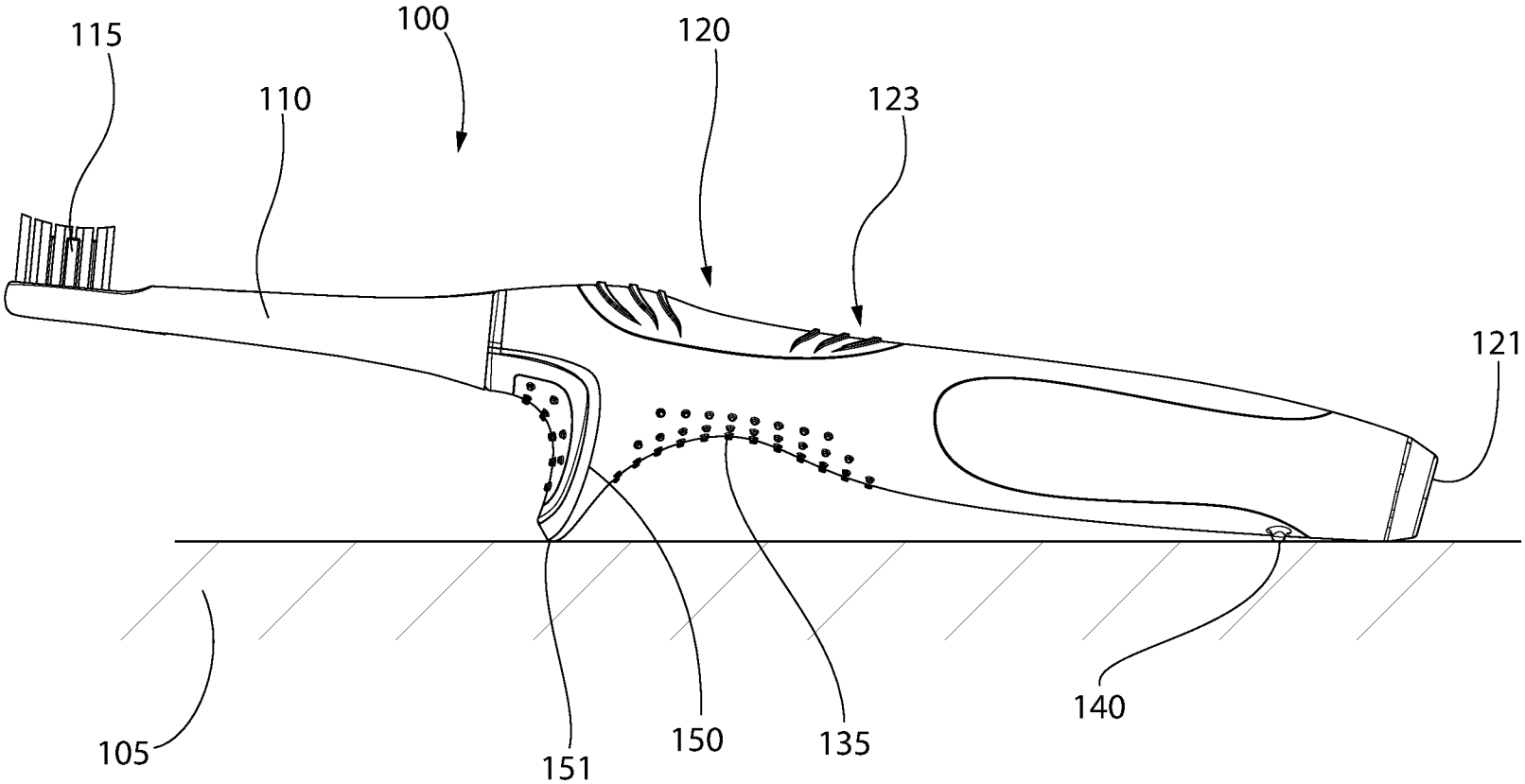
FIG. 7 is a side view of the oral care implement of FIG. 1 resting on a horizontal surface.

Turning now to FIG. 7, the oral care implement 100 is illustrated resting atop of a horizontal support surface 105. The horizontal support surface 105 may be a countertop, a desktop, or any other surface upon which an oral care implement 100 may be put during a period of non-use. When the oral care implement 100 is rested against the horizontal support surface 105, the free distal end 151 of the grip stop 150 and the stand protuberances 140 are in direct physical contact with the horizontal support surface 105. Furthermore, the entire head portion 110 is elevated above the horizontal support surface 105 so that the head portion 110 and the tooth cleaning elements 115 thereon do not contact the horizontal support surface 105.

In addition to keeping the head portion 110 above the horizontal support surface 105 to prevent bacteria and the like from getting onto the tooth cleaning elements 115, the combination of the grip stop 150 and the depression 135 also ensures that there is a significant gap between the exposed surface outer surface 128 of the gripping portion 123 and the horizontal support surface 105 along the depression 135. That is, the depression 135 is spaced from the horizontal support surface 105 by a gap that is approximately as large as the height H1 of the grip stop 150. This gap provides a space for a user to insert his or her fingers in order to pick up the oral care implement 100 for use, without the horizontal support surface 105 creating an interference.

FIGS. 8 and 9 illustrate two different grip configurations for holding the oral care implement 100 during use. In FIG. 8, the user is gripping the oral care implement 100 with the thenar webspace (the area of skin between the thumb and index finger) of the hand aligned with an in abutting contact with the lower wall surface 153 of the grip stop 150. The fingers then wrap around the front exposed surface 138 of the gripping portion 120. FIG. 9 is a slightly different grip configuration. In FIG. 9, the user's thumb is resting on the thumb grip 130 and the top edge of the user' index finger (the part that faces the thumb) abuts against the lower wall surface 153 of the grip stop 150. In either case, the grip stop 150 is configured to prevent the user's hand from moving relative to the gripping portion 123 in a direction from the handle proximal end 121 to the handle distal end.

Referring now to FIGS. 10-13, an oral care implement 200 will be described in accordance with an embodiment of the present invention. The oral care implement 200 has a similar function to the oral care implement 100 and is a manual toothbrush in the exemplified embodiment, although it could take on other forms such as those mentioned above with regard to the oral care implement 100. The oral care implement 200 generally comprises a head portion 210 and a handle portion 220. The head portion 210 is detachable from the handle portion 220 in the exemplified embodiment, although the head and handle portions 210, 220 could be integral in other embodiments. The head portion 210 comprises tooth cleaning elements 215 and is generally identical to the head portion 110 described above. Thus, the description of the head portion 110 is entirely applicable to the head portion 210 and no further description of the head portion 210 will be provided here in the interest of brevity.

The handle portion 220 extends from a handle proximal end 221 to a handle distal end 222 along a handle axis C-C. The handle portion 220 generally comprises a gripping portion 223 configured to be gripped by a hand of a user and extending along the handle axis C-C, a stem portion 224 configured for attachment to the head portion 210, and a grip stop 250 protruding from the gripping portion 223 in a cantilevered manner in a direction orthogonal to the handle axis C-C. The stem portion 224 could be omitted and would be in embodiments whereby the head portion 210 is integral with the handle portion 220, as opposed to the detachable embodiment set forth in the exemplified drawings.

Figure 13:
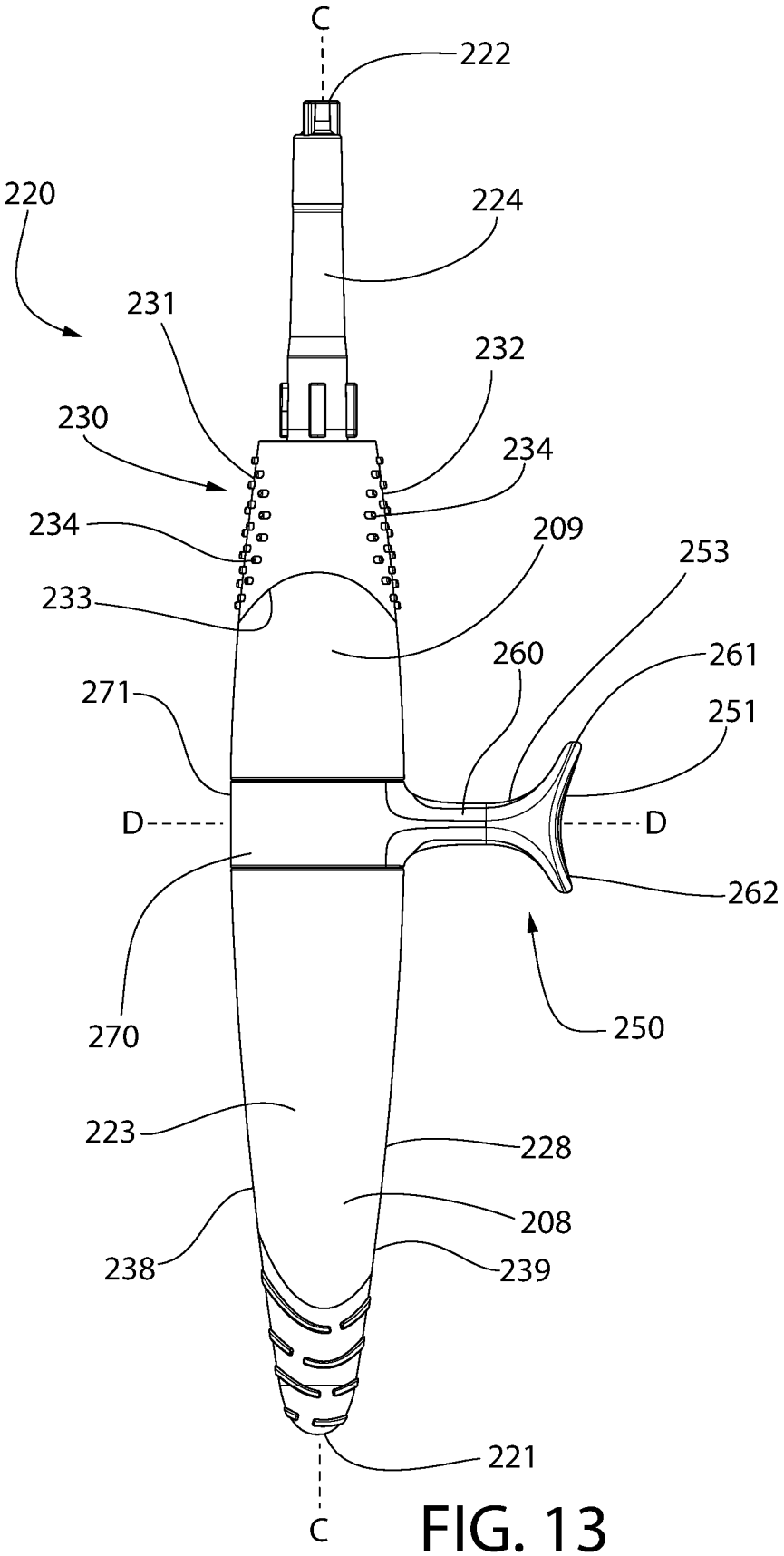
FIG. 13 is a side view of the handle portion of the oral care implement of FIG. 10.
Figure 14:
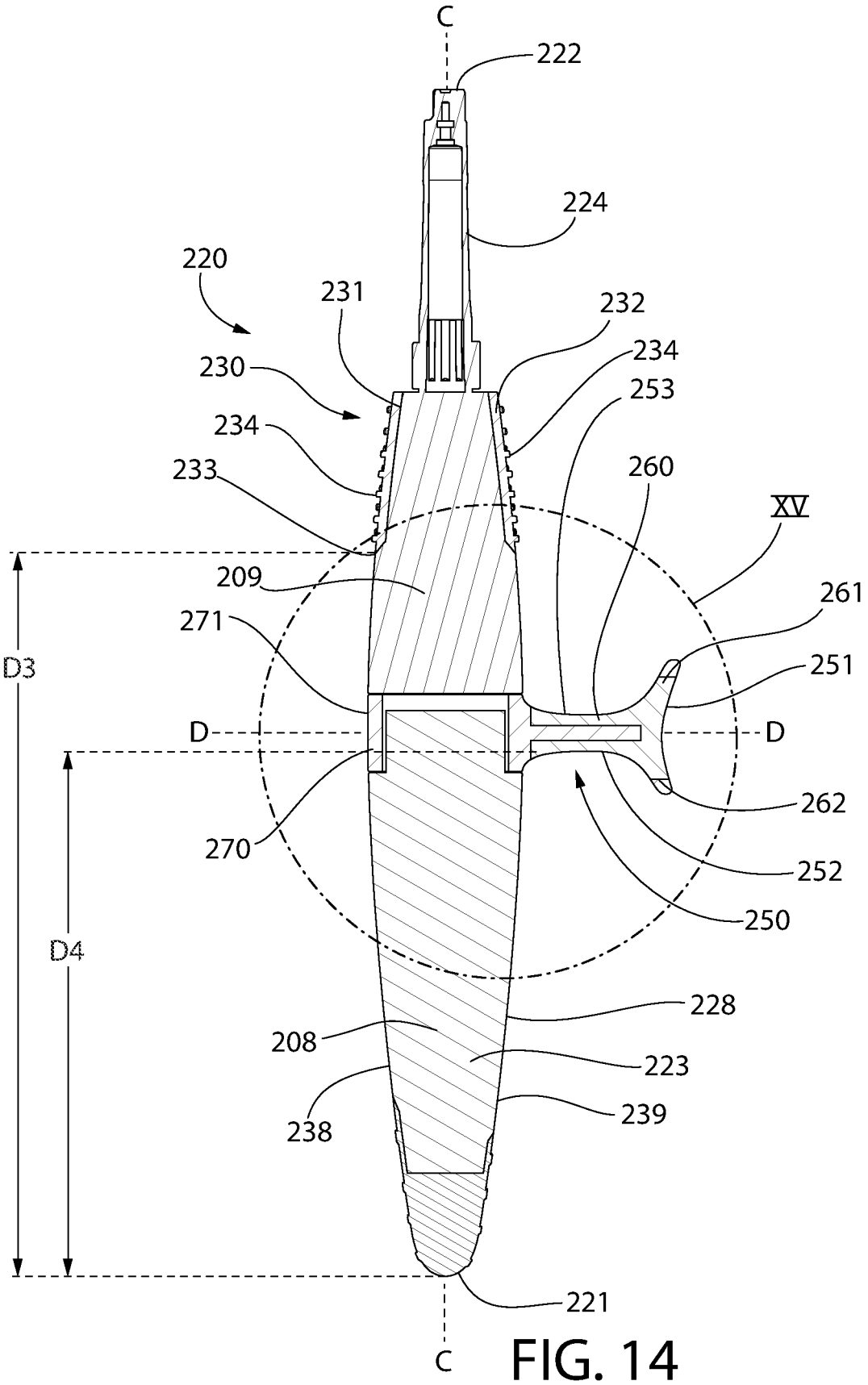
FIG. 14 is a cross-sectional view taken along line XIV-XIV of FIG. 12.
Figure 15:
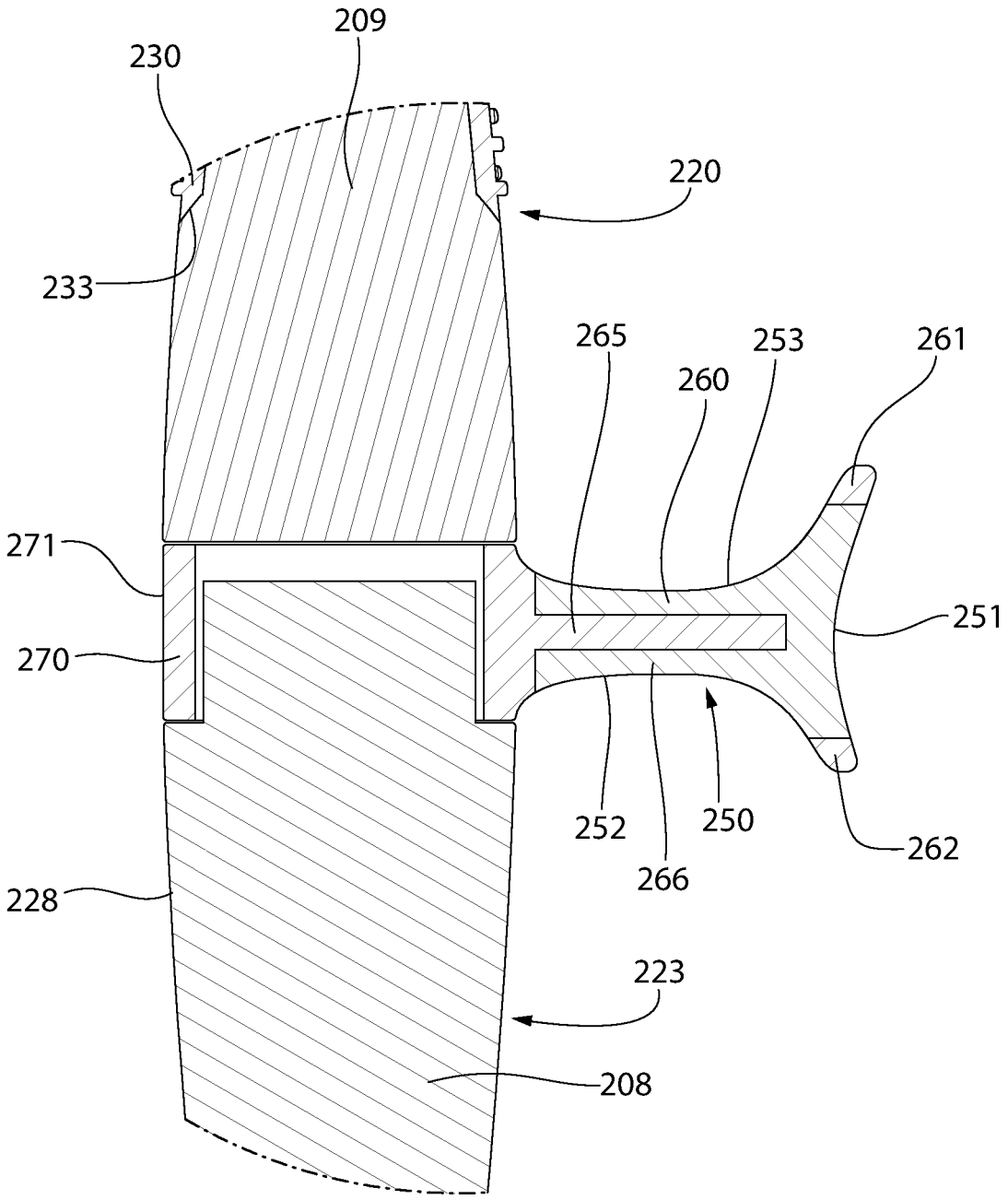
FIG. 15 is a close-up of area XV of FIG. 14.

Referring to FIGS. 13-15, the grip stop 250 will be further described. The grip stop 250 extends from an exposed surface outer surface 228 of the gripping portion 223 to a free distal end 251 along a grip stop axis D-D. In the exemplified embodiment, the grip stop axis D-D is perpendicular to the handle axis C-C. The free distal end 251 of the grip stop 250 comprises a concave surface in this embodiment. In particular, the free distal end 251 is concave along its entirety in the exemplified embodiment. The grip stop 250 may have a height measured from the exposed surface outer surface 228 to the free distal end 251 that is equal to or greater than 16 mm.

The grip stop 250 comprises a post portion 260 protruding from the gripping portion 223, a first flange portion 261 extending from the post portion 260 in a first axial direction, and a second flange portion 262 extending from the post portion 260 in a second axial direction. In the exemplified embodiment, the first flange portion 261 extends in an upward axial direction towards the handle distal end 222 and the second flange portion 262 extends in a downward axial direction towards the handle proximal end 221. Thus, the grip stop 250 including the post portion 260 and the first and second flange portions 261, 262 has a generally T-shaped profile.

In the exemplified embodiment, handle portion 220 comprises a lower handle part 208 and an upper handle part 209 that are operably coupled together to form the handle portion 220. Although the manner in which the lower and upper handle parts 208, 209 is not specifically depicted in the drawings, this coupling may be achieved by screw threads, friction fit, snap fit, mating mechanical engagement features, fasteners, or the like in various different embodiments. In other embodiments, the handle portion 220 may be formed as a singular part rather than two separate parts that are coupled together, without detracting from the structure and function described and claimed herein.

Furthermore, in the exemplified embodiment the oral care implement 200 comprises a collar component 270. The collar component 270 is disposed between the lower and upper handle parts 208, 209 and is configured to rotate about the handle axis C-C relative to the lower and upper handle parts 208, 209 (i.e., relative to the handle portion 220). In the exemplified embodiment the collar component 270 is configured to rotate around the lower handle part 208, although in other embodiments the collar component 270 may rotate around the upper handle part 209, depending on the structure and attachment between the lower and upper handle parts 208, 209. The collar component 270 comprises an exposed outer surface 271 that is substantially flush with the exposed surface outer surface 228 of the gripping portion 223 of the handle portion 220. The term substantially used herein allows for miniscule differences whereby one of the collar component 270 and the gripping portion 223 protrudes by a small amount relative to the other (in the order of no more than 0.5 mm).

The grip stop 150 is coupled to and extends from the exposed outer surface 271 of the collar component 270. In fact, in the exemplified embodiment the collar component 270 and the grip stop 150 are formed as an integral, monolithic component. Thus, because the collar component 270 is configured to pivot or rotate about the handle axis C-C relative to the gripping portion 223 of the handle portion 220, so too is the grip stop 150 configured to rotate or pivot about the handle axis C-C.

The post portion 260 of the grip stop 250 comprises a lower wall surface 252 that faces downwardly towards the handle proximal end 221 and an upper wall surface 253 that faces upwardly towards the handle distal end 222. Each of the lower and upper wall surfaces 252, 253 is a concave surface in the exemplified embodiment. The invention is not to be limited by this in all embodiments and one or both of the lower and upper wall surfaces 252, 253 could be flat or convex in other embodiments. However, as will be discussed further below, the post portion 260 of the grip stop 250 is configured to nest between adjacent fingers of a user's hand, and thus having the lower and upper wall surfaces 252, 253 be concave increases comfort to the user.

The handle portion 220 also comprises a thumb grip 230. The thumb grip 230 comprises a rear portion 232 located on a rear exposed surface 239 of the gripping portion 223 of the handle portion 220 and a front portion 231 located on a front exposed surface 238 of the gripping portion 223 of the handle portion 220. The thumb grip 230 is located adjacent to the handle distal end 222. In the exemplified embodiment, gripping protrusions 234 protrude from the front and rear portions 231, 232 of the thumb grip 230. The gripping protrusions 234 are nub-like protrusions in the exemplified embodiment, but they may take on other shapes and forms in other embodiments. Furthermore, the thumb grip 230 comprises a lower end 233 located at an axial distance D3 from the handle proximal end 221. Furthermore, the grip stop 250 is located at an axial distance D4 from the handle proximal end 221, the axial distance D4 being less than the axial distance D3. Thus, the grip stop 250 is located closer to the handle proximal end 221 than the thumb grip 230.

As best shown in FIG. 15, the post portion 260 of the grip stop 250 comprises a first portion 265 formed from a rigid material such as plastic and a second portion 266 formed from an elastomeric material such as a thermoplastic elastomer, a thermoplastic polyurethane, a rubber, or the like. The first portion 265 of the post portion 260 is substantially entirely covered by the second portion 266. Thus, the second portion 266 of the post portion 260 forms the lower and upper wall surfaces 252, 253 which come into contact with the user's fingers during use of the oral care implement 200. This provides a soft, and potentially compressible contact between the user's fingers and the grip stop 250. In the exemplified embodiment, the first portion 265 of the post portion 260 is integral with the collar component 270 and the second portion 266 of the post portion 260 is overmolded onto the first portion 265 of the post portion 260. Moreover, in the exemplified embodiment the first and second flange portions 261, 262 of the grip stop 250 are both formed entirely from an elastomeric material (integrally with the second portion 266 of the post portion 260). Thus, the first and second flange portions 261, 262 may be pliable, compressible, flexible, or the like thereby making them more comfortable to a user who is using the oral care implement 200. In other embodiments, the exterior of the grip stop 250 may be rigid and the flexible elastomeric material may only form the lower and upper wall surfaces 252, 253, or portions thereof, and potentially also the free distal end 251, or portions thereof.

Figure 16A:
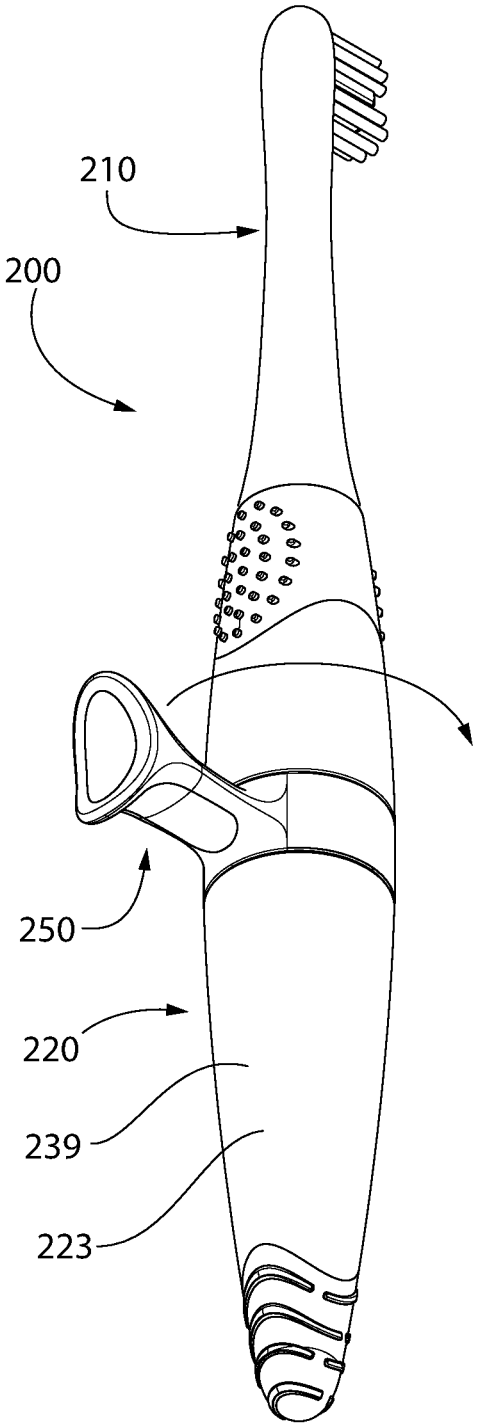
FIGS. 16A and 16B are rear perspective views of the oral care implement of FIG. 10 illustrating pivoting or rotational movement of a grip stop thereof.
Figure 16B:
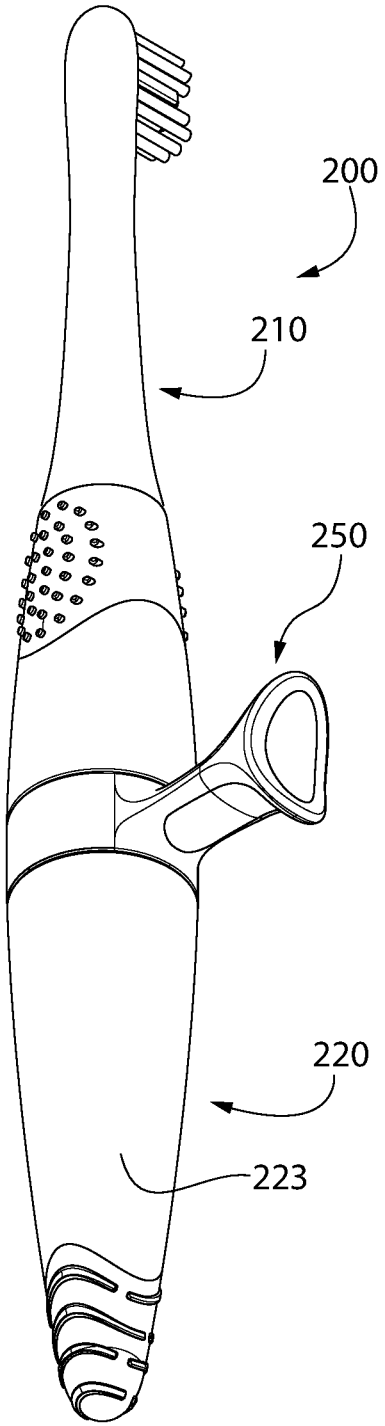

FIGS. 16A and 16B illustrate the pivoting or rotation of the grip stop 250 relative to the gripping portion 223 of the handle portion 220. Specifically, in FIG. 16A the grip stop 250 is illustrated as protruding from the rear exposed surface 339 of the gripping portion 223 of the handle portion 220. FIG. 16B illustrates the grip stop 250 protruding from a side surface of the gripping portion 223 of the handle portion 220. Thus, the grip stop 250 is rotated 45° from the position shown in FIG. 16A to the position shown in FIG. 16B. The grip stop 250 may be configured for a full 360 degree rotation relative to the gripping portion 223 so that a user can position the grip stop 250 at any circumferential position relative to the gripping portion 223 as may be desired and most comfortable for that particular user.

The oral care implement 200 may include various stop positions for the grip stop 250. For example, there may be ribs along the interior of the collar component 270 that engage ribs or detents along the portion of the handle portion 220 which the collar component 270 surrounds. Thus, as the grip stop 250 moves to certain positions, the grip stop 250 may become locked in those positions such that a certain force is required to continue rotation of the grip stop 250. In other embodiments, such locking features may not be included. There are no such locking features in the exemplified embodiment and the grip stop 250 is therefore freely rotatable relative to the gripping portion 223.

Figure 17:
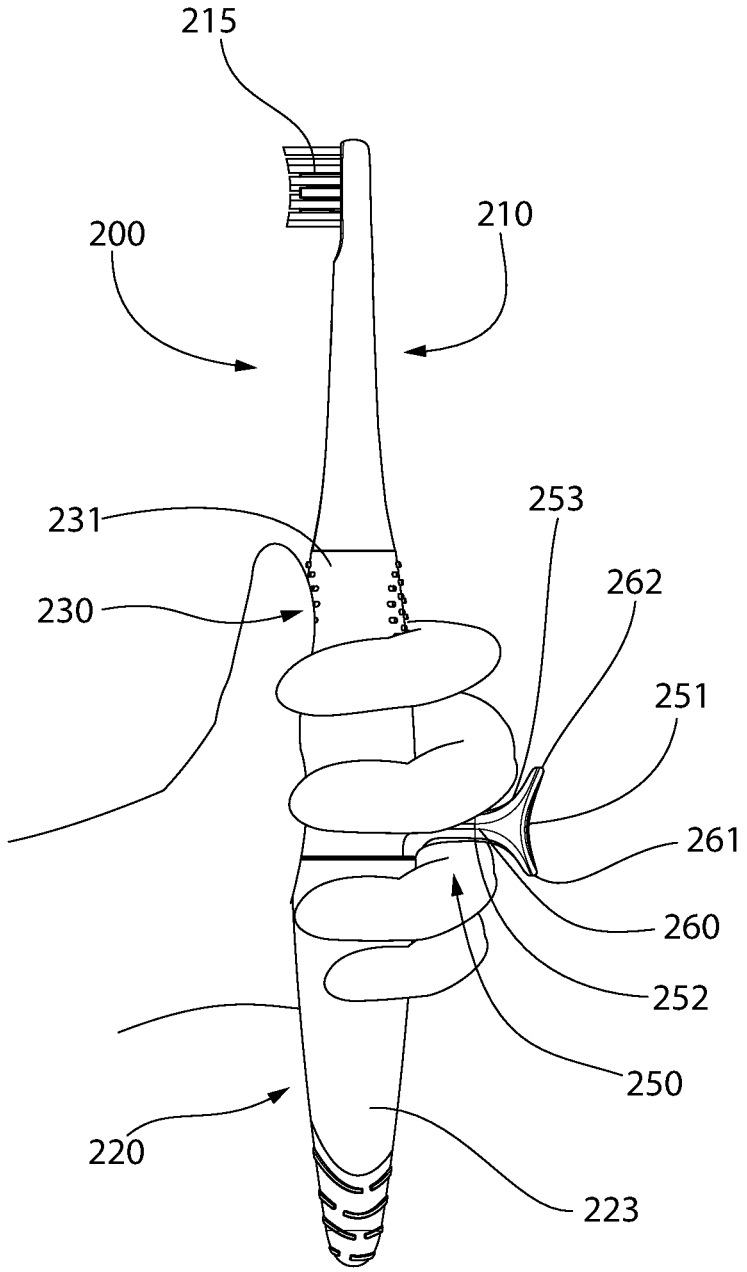
FIG. 17 is a side view of the oral care implement of FIG. 10 being held by a user's hand.

FIG. 17 illustrates the oral care implement 200 being held by a user's hand. As shown, the oral care implement 200 is intended to be held so that the grip stop 250 extends between and nestingly receives adjacent fingers on the user's hand. In this embodiment shown, the user's middle finger rests atop of the upper wall surface 253 of the post portion 260 of the grip stop 250 and the user's middle finger rests in contact with the lower wall surface 252 of the post portion 260 of the grip stop 250. The post portion 260 therefore extends into and through the space between the user's ring and middle fingers. The user's fingers may abut against the interior surfaces of the first and second flange portions 261, 262 of the grip stop 250 (the interior surfaces being opposite the free distal end 251. Furthermore, the user's thumb rests against the front portion 231 of the thumb grip 230.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a handle portion extending from a handle proximal end to a handle distal end along a handle axis, the handle portion comprising:

a gripping portion configured to be gripped by a hand of a user and extending along the handle axis; and a grip stop protruding from the gripping portion in a cantilevered manner, the grip stop comprising: a post portion protruding from the gripping portion; a first flange portion extending from the post portion in a first axial direction; and a second flange portion extending from the post portion in a second axial direction opposite the first axial direction, the grip stop pivotably coupled to the gripping portion so as to be pivotable about the handle axis, the grip stop configured to contact the hand of the user to prevent movement of the hand, relative to the gripping portion, in a direction from the handle proximal end to the handle distal end.

2. The oral care implement according to claim 1 wherein the grip stop terminates in a free distal end.

3. The oral care implement according to claim 2 wherein the grip stop has a minimum height measured orthogonal to the handle axis from an exposed surface of the gripping portion at a base of the grip stop to the free distal end, wherein the minimum height is greater than a maximum radius of the gripping portion, measured orthogonal to the handle axis from the handle axis to an exposed surface of the gripping portion.

4. The oral care implement according to claim 2 wherein the grip stop has a minimum height measured orthogonal to the handle axis from an exposed surface of the gripping portion at a base of the grip stop to the free distal end, and wherein the minimum height is greater than or equal to 16 mm.

5. The oral care implement according to claim 2 further comprising:

a head portion coupled to the handle distal end of the handle portion, the head portion comprising one or more tooth cleaning elements extending from a front surface of the head portion in a first direction; and the grip stop protruding from a rear exposed surface of the gripping portion in a second direction opposite the first direction.

6. The oral care implement according to claim 5 wherein the handle is configured so that the oral care implement can be supported on a horizontal surface by the free distal end of the grip stop and one or more stand protuberances located on the rear exposed surface of the gripping portion adjacent the handle proximal end.

7. The oral care implement according to claim 1 further comprising:

a thumb grip on a front exposed surface of the gripping portion, the thumb grip comprising a lower end located a first axial distance from the handle proximal end; and the grip stop protruding from a rear exposed surface of the gripping portion, a free distal end of the grip stop located a second axial distance from the handle proximal end, the second axial distance being greater than the first axial distance.

8. The oral care implement according to claim 7 wherein the free distal end of the grip stop is radially aligned with the thumb grip.

9. The oral care implement according to claim 7 wherein the thumb grip comprises a plurality of first gripping protuberances.

10. The oral care implement according to claim 1 wherein the grip stop comprises a lower wall surface, an upper wall surface, and a plurality of second gripping protuberances protruding from at least one of the upper and lower wall surfaces.

11. The oral care implement according to claim 1 wherein the grip stop comprises a lower wall surface and an upper wall surface, each of the upper and lower wall surfaces having a concave portion.

12. The oral care implement according to claim 1 wherein the gripping portion comprises an exposed surface having a depression adjacent the grip stop.

13. The oral care implement according to claim 1 wherein the grip stop is located adjacent the handle distal end.

14. The oral care implement according to claim 1 wherein the grip stop has a generally T-shaped profile.

15. The oral care implement according to claim 1 further comprising a collar component, the grip stop coupled to the collar component, the collar component pivotably coupled to the gripping portion; and wherein the collar component comprises an exposed outer surface that is substantially flush with an exposed outer surface of the gripping portion.

16. The oral care implement according to claim 1 wherein the grip stop is configured to extend between and nestingly receive adjacent fingers on the hand of the user.

17. The oral care implement according to claim 1 wherein the grip stop terminates in a free distal end comprising a concave surface.

18. The oral care implement according to claim 1 further comprising:

a thumb grip on a front exposed surface of the gripping portion, the thumb grip located adjacent the handle distal end and comprising a lower end located a first axial distance from the handle proximal end; and the grip stop located a second axial distance from the handle proximal end, the second axial distance being less than the first axial distance.

* * * * *